US009851170B1

(12) United States Patent
Liu

(10) Patent No.: US 9,851,170 B1
(45) Date of Patent: Dec. 26, 2017

(54) ARROW RETENTION DEVICE OF CROSSBOW

(71) Applicant: Chi-Chang Liu, Taichung (TW)

(72) Inventor: Chi-Chang Liu, Taichung (TW)

(73) Assignee: POE LANG ENTERPRISE CO., LTD., Chi-Chang Liu ( * ) Notice: Subject to any disclaimer, the term of this patent is extended or adjusted under 35 U.S.C. 154(b) by 0 days.

(21) Appl. No.: 15/586,290

(22) Filed: May 4, 2017

(51) Int. Cl.
*F41B 5/12* (2006.01)

(52) U.S. Cl.
CPC ..... *F41B 5/12* (2013.01); *F41B 5/123* (2013.01)

(58) Field of Classification Search
CPC ..... F41B 5/12; F41B 5/123
See application file for complete search history.

(56) References Cited

U.S. PATENT DOCUMENTS 6,802,304 B1 * 10/2004 Chang ..... F41B 5/1469 124/25
7,588,022 B2 * 9/2009 Chang ..... F41B 5/123 124/25
7,770,567 B1 * 8/2010 Yehle ..... F41A 17/46 124/25
2009/0194086 A1 * 8/2009 Kempf ..... F41A 19/10 124/25
2015/0260477 A1 * 9/2015 Khoshnood ..... F41B 5/12 124/25

* cited by examiner

*Primary Examiner* — John Ricci

(57) ABSTRACT

An arrow retention device of a crossbow includes a fixing member which has one end thereof fixed to the shooting device, and an installation slot is defined axially in the underside of the fixing member. An arm is pivotably inserted into the installation slot and has a first end and a second end. The first end is exposed beyond the installation slot, and the second end of the arm is inserted into the shooting device. A restriction rod extends from each of two sides of the arm. A pushing spring connected to the top of the arm is biased between the second end of the arm and the shooting device. A retention member is connected to the arm and includes a contact portion for pressing an arrow. When shooting the arrow, the pushing spring pivots the arm back, and the contact portion is separated from the arrow.

7 Claims, 10 Drawing Sheets

ARROW RETENTION DEVICE OF CROSSBOW

BACKGROUND OF THE INVENTION

1. Fields of the Invention

The present invention relates to a crossbow, and more particularly, to an arrow pressing device of a crossbow and the pressing device firmly positions the arrow before shooting.

2. Descriptions of Related Art

The conventional crossbow comprises a b, a riser, a string, a barrel, a foregrip, a trigger unit, a stock and a retention member. An arrow is first put in the flight groove and the retention member presses on the arrow to ensure that the arrow does not shift such that the arrow can be sent to the target as expected. Nevertheless, when the user pulls the trigger to shoot the arrow, the retention member still applies a downward force to the arrow. The downward force pushes the rear end of the arrow and the arrow head slightly tilt upward. Besides, the downward force from the retention member reduces the speed when the arrow leaves the crossbow. The retention member will be worn out due to friction so that the retention member gradually fails to correctly press the arrow.

The present invention intends to provide an arrow retention device to eliminate the shortcomings mentioned above.

SUMMARY OF THE INVENTION

The present invention relates to an arrow retention device of a crossbow, and the arrow retention device comprises a fixing member having one end thereof fixed to a shooting device of the crossbow, and an installation slot is defined axially in the underside of the fixing member. An arm is pivotably inserted into the installation slot and has a first end and a second end. The first end is exposed beyond the installation slot, and the second end of the arm is inserted into the shooting device. A restriction rod extends from each of two sides of the arm. A pushing spring is connected to the top of the arm and biased between the second end of the arm and the shooting device. A retention member is connected to the end face of the first end of the arm and comprises a connection portion, a shank and a guide portion. The connection portion is connected to the end face of the first end of the arm and the first end of the shank. The second end of the shank is connected to the guide portion. The connection portion and the guide portion respectively extend toward, two opposite directions. A contact portion is formed at the connection portion of the shank and the guide portion. The contact portion presses the arrow put in the flight groove of the crossbow.

When the arrow is put in the shooting device, the rear end of the arrow pivots the arm so that the first end of the am drives the retention member toward the arrow. The contact portion presses the arrow. The second end of the arm compresses the pushing spring. When the shooting device is activated to shoot the arrow, the arrow leaves from the arm, and the pushing spring releases the recovery force to pivot the arm back, and the contact portion is separated from the arrow. Therefore, the arrow does not tilt when shooting.

The present invention become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
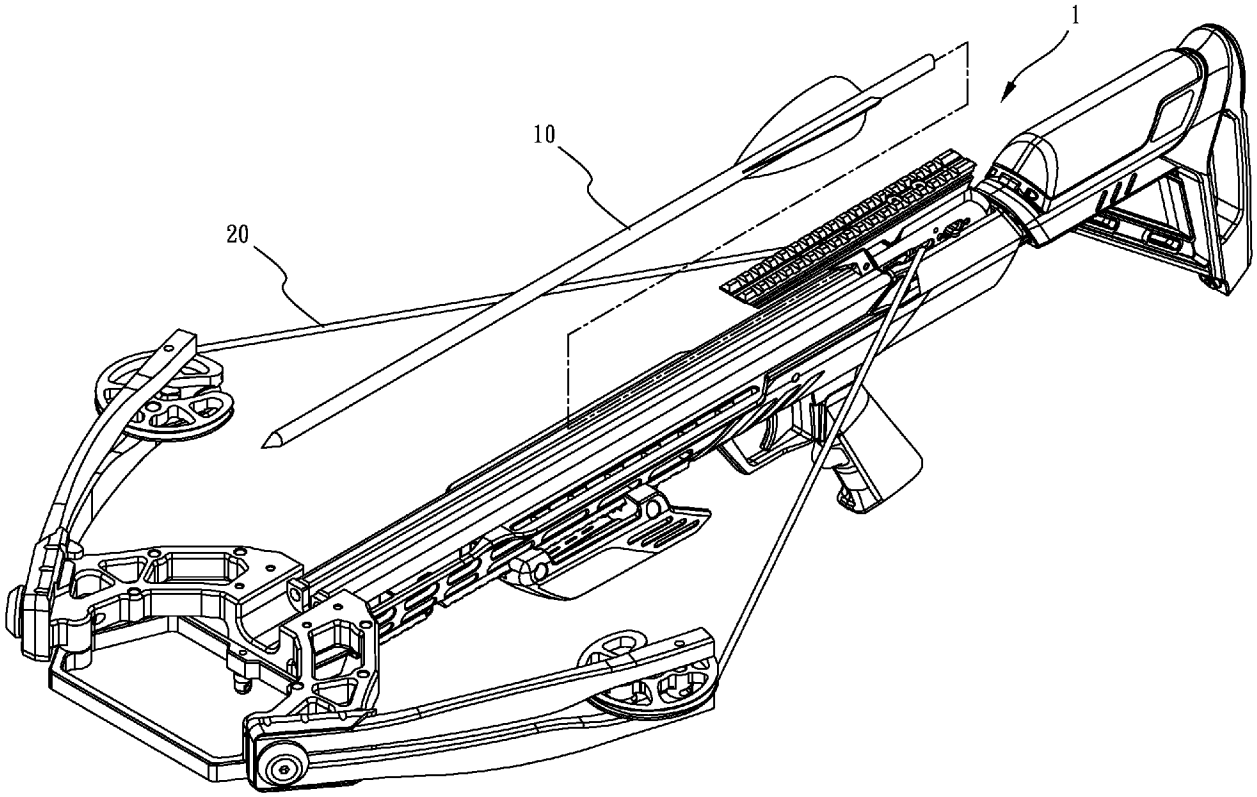
FIG. 1 shows that the arrow retention device of the present invention is installed to a crossbow.
Figure 2:
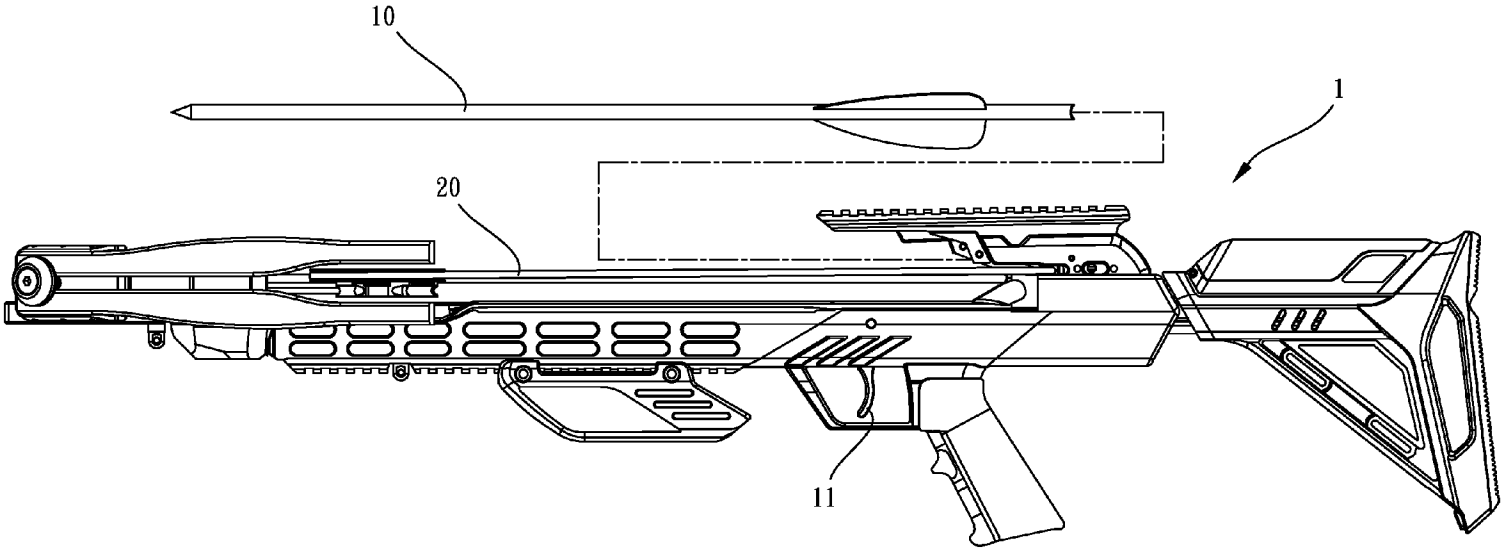
FIG. 2 is a side view to show that the arrow retention device al the present invention is installed to a crossbow.

Referring to FIGS. 1 to 10, the arrow retention device of the present invention comprises a fixing member 2 having one end thereof fixed to a shooting device 1. An installation slot 21 is defined axially in the underside of the fixing member 2. An arm 3 is pivotably inserted into the installation slot 21 and includes a first end 31 and a second end 32, wherein the first end. 31 is exposed beyond the installation slot 21, and the second end of the arm 3 is inserted into the shooting device 1. A restriction rod 33 extends from each of two sides of the arm 3. A pushing spring 4 is connected to the top of the arm 3, and biased between the second end 32 of the arm 3 and the shooting device 1. A retention member 5 is connected to the end face of the first end 31 of the arm 3 and comprises a connection portion 51, a shank 52 and a guide portion 53. The connection portion 51 connected to the end face of the first end 31 of the arm 3 and the first end of the shank 52. The second end of the shank 52 is connected to the guide portion 53. The connection portion 51 and the guide portion 53 respectively extend toward two opposite directions. A contact portion 54 is formed at the connection portion of the shank 52 and the guide portion 53. The contact portion 54 presses an arrow 10 in the fight groove of the crossbow.

When the arrow 10 is put in the shooting device 1, the rear end of the arrow 10 pivots the arm 3 so that the first end 31 of the arm 3 drives the retention member 5 toward the arrow 10. The contact portion 54 presses the arrow 10, and the second end 32 of the arm 3 compresses the pushing spring 4. This ensures that the arrow 10 does not shift before pulling the trigger 11.

When the shooting device 1 is activated to shoot the arrow 10 by pulling the trigger 11, the arrow 10 leaves from the arm 3 and the pushing spring 4 releases a recovery force, so that the second end 32 of the arm 3 is pivoted back (downward), and the first end 31 of the arm 3 and the contact portion 54 are separated from the arrow 10. By this specific arrangement of the present invention, the arrowhead of the arrow 10 does not tilt upward when the string sends the arrow 10 toward the target as shown in FIGS. 6 to 10.

Figure 6:
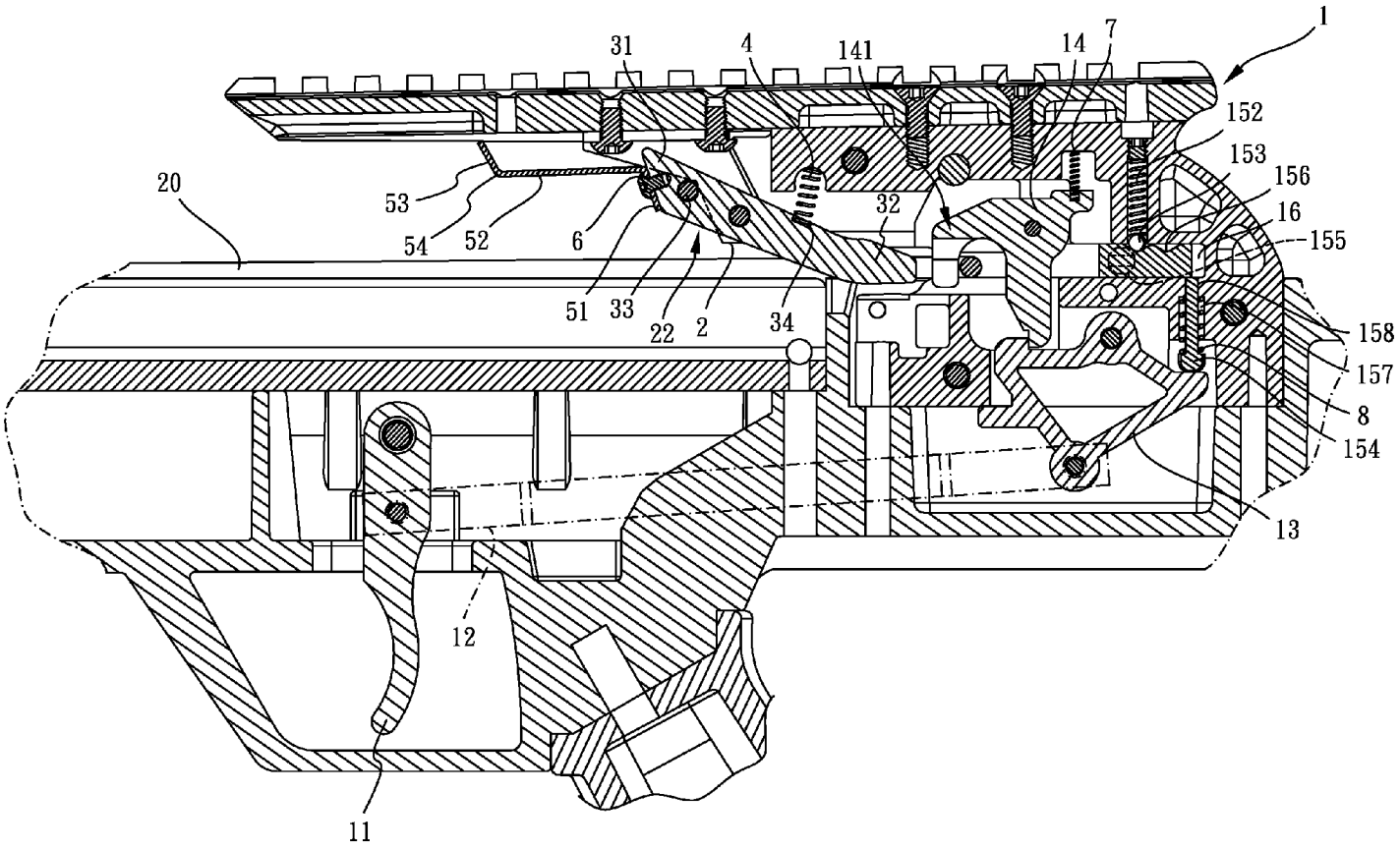
FIG. 6 is an enlarged cross sectional view of the arrow retention device of the present invention and a portion of the shooting device of the crossbow.
Figure 7:
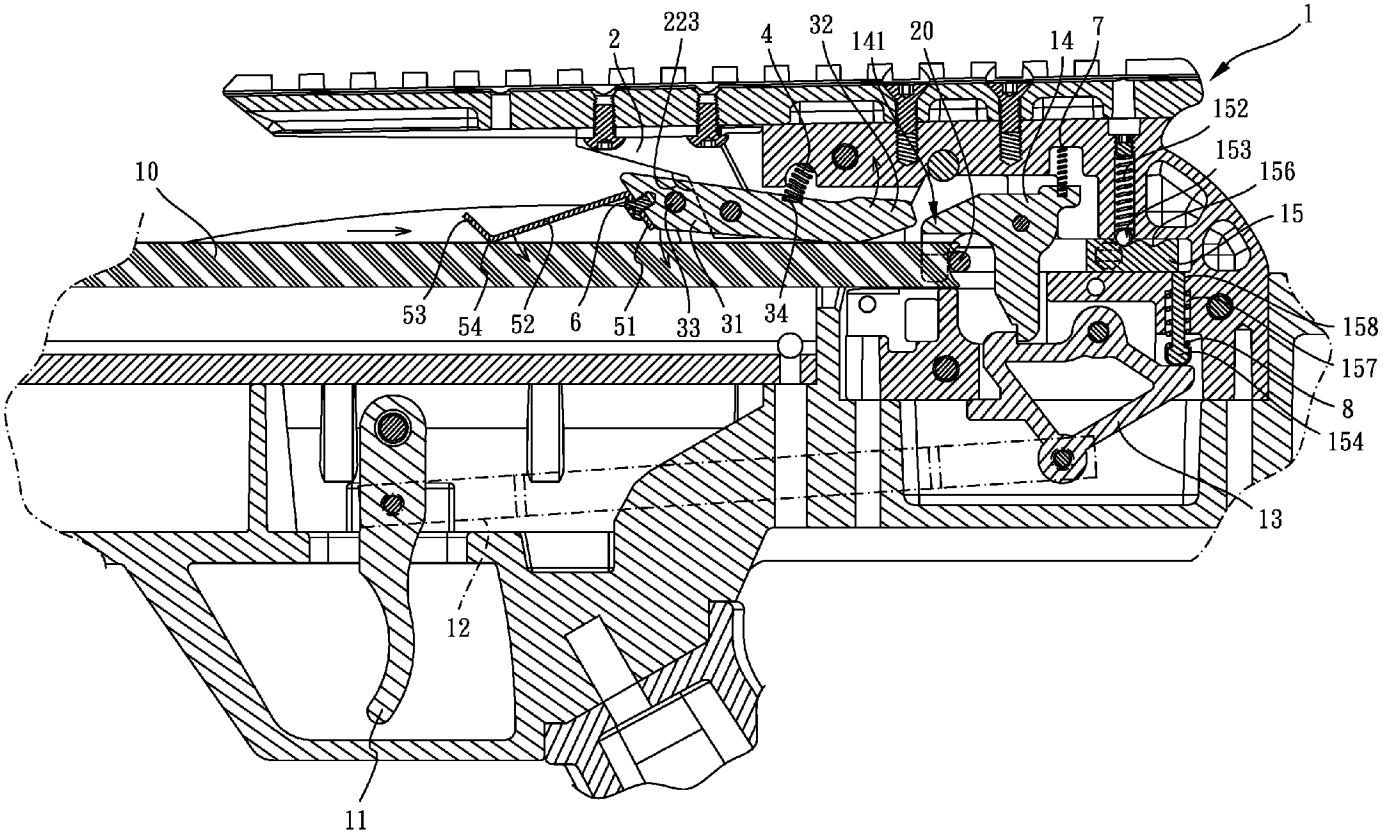
FIG. 7 shows that an arrow is put to the crossbow, the arm is pivoted and the retention member presses the arrow.
Figure 8:
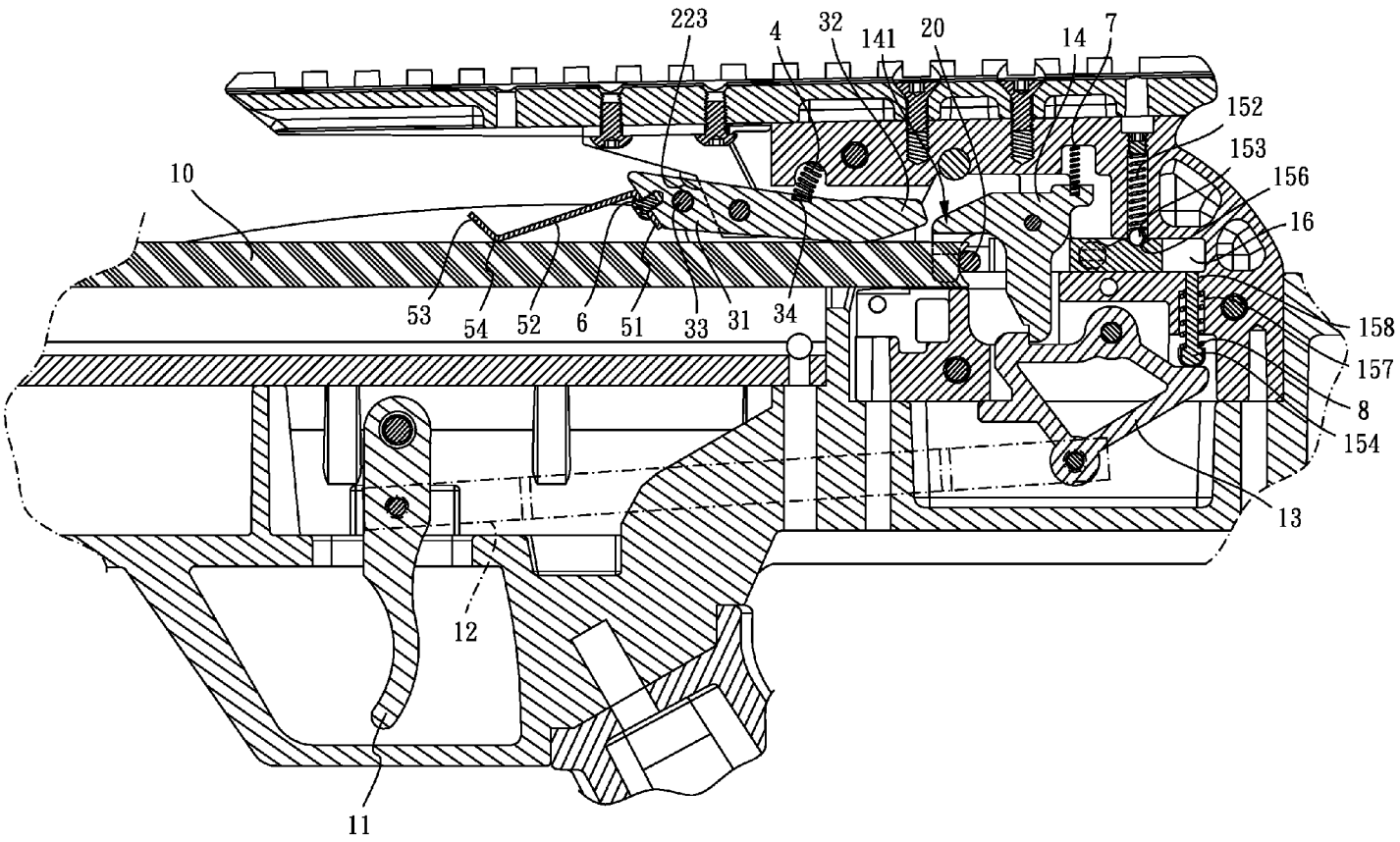
FIG. 8 shows that the safety unit is released, and the arrow is ready to shoot.
Figure 9:
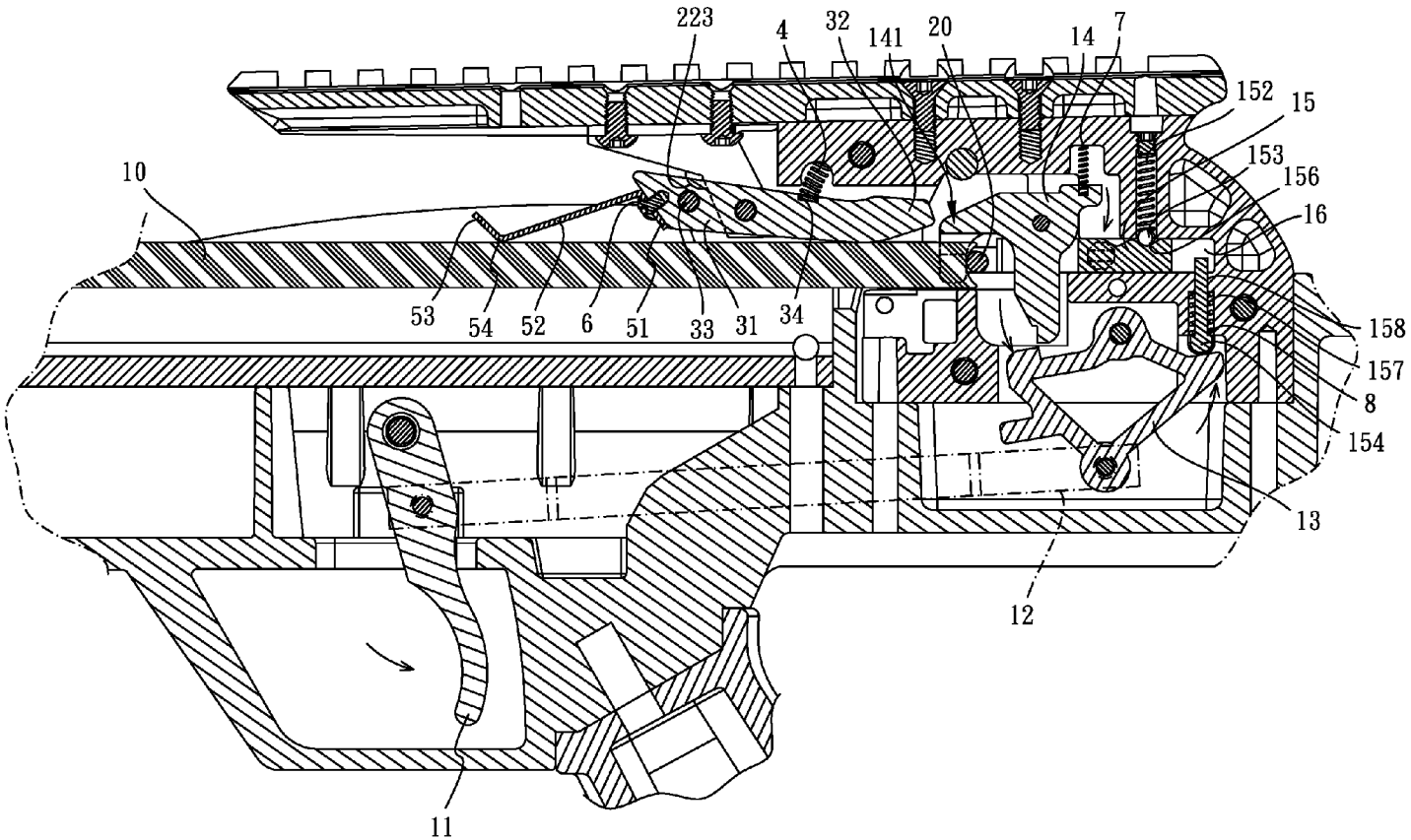
FIG. 9 shows that the user begins to pull the trigger.
Figure 10:
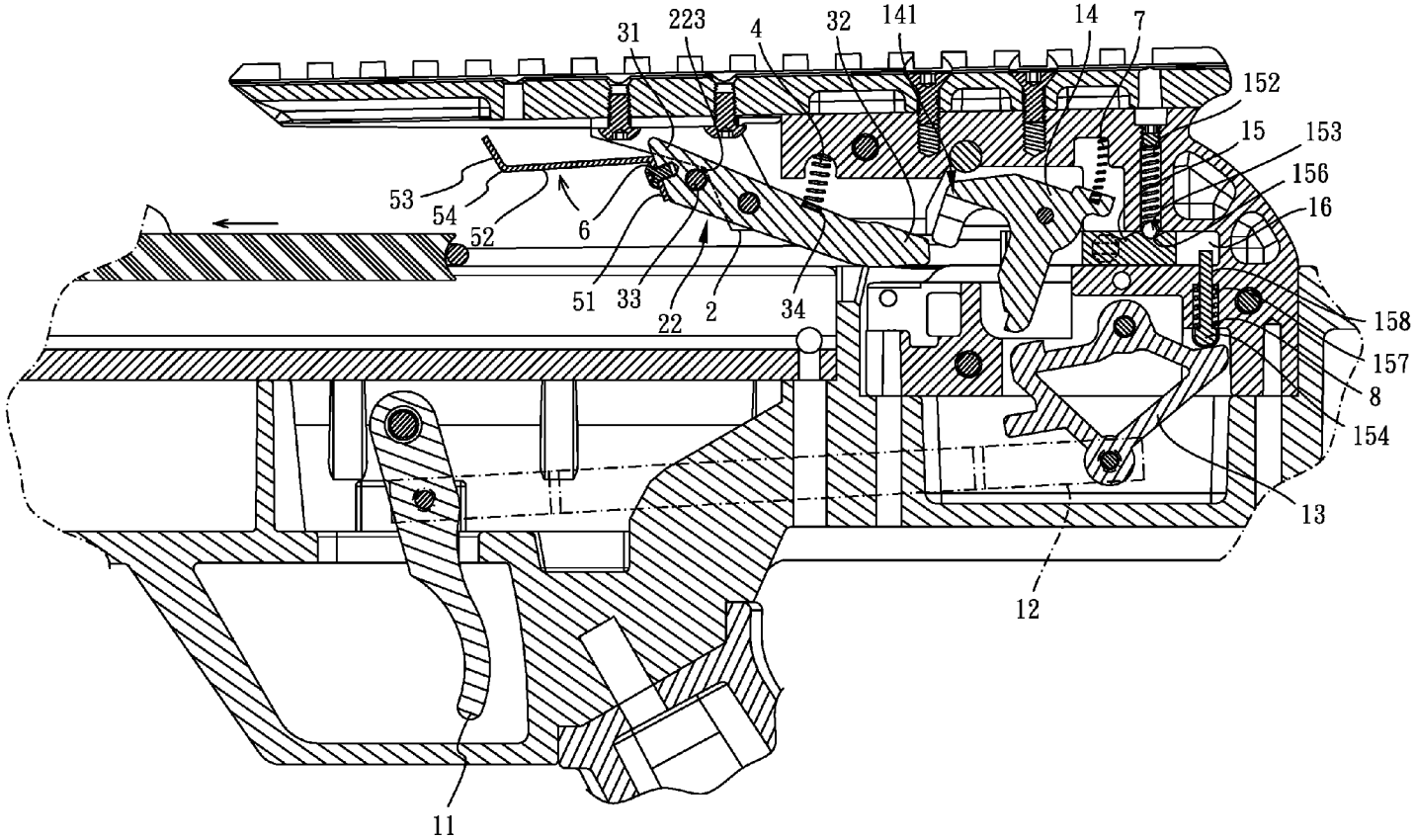
FIG. 10 shows that the retention member is separated the arrow when the trigger is pulled.

The fixing member 2 includes two notches 22 which are located corresponding to the restriction rods 33. Each notch 22 includes a first inclined face 221 and a second inclined face 222, and an angled area 223 is formed between the first and second inclined faces 221, 222. The angle of the angled area. 223 is larger than 90 degrees or equal to 90 degrees. The restriction rods 33 are engaged with the angled area 223 when the arm 3 is not pivoted, and the restriction rods 33 are move away from the angled area 223 when the arm 3 is pivoted. When the angle is larger than 90 degrees, the time that the restriction rods 33 contact the angled area 223 is faster than that when the angle is equal to 90 degrees. The users can use the feature to adjust the crossbow according to individual needs. As shown in FIGS. 9 and 10, the setting to the angle relates the time required to install an arrow 10 to the crossbow. Besides, in order to prevent the pushing spring 4 from disengaged from its position by the pressure from the second end 32 of the arm 3, the arm 3 includes a recess 34 which is located corresponding to the pushing spring 4, and one end of the pushing spring 4 is securely engaged with the recess 34. Therefore, the pushing spring 4 does not disengaged from the recess 34 when the second end 32 compresses the pushing spring 4. The pushing spring 4 can provide a stable recovery force to the arm 3. The recovery force from the pushing spring 4 relates the time that the arm 3 pivots back, so that the users may use the angle setting of the angled area 223 and the pushing spring 4 to install the arrow 10 to the crossbow quickly. The force of the pushing spring 4 affects the speed that the arm 3 pivots back as shown in FIG. 6.

Figure 3:
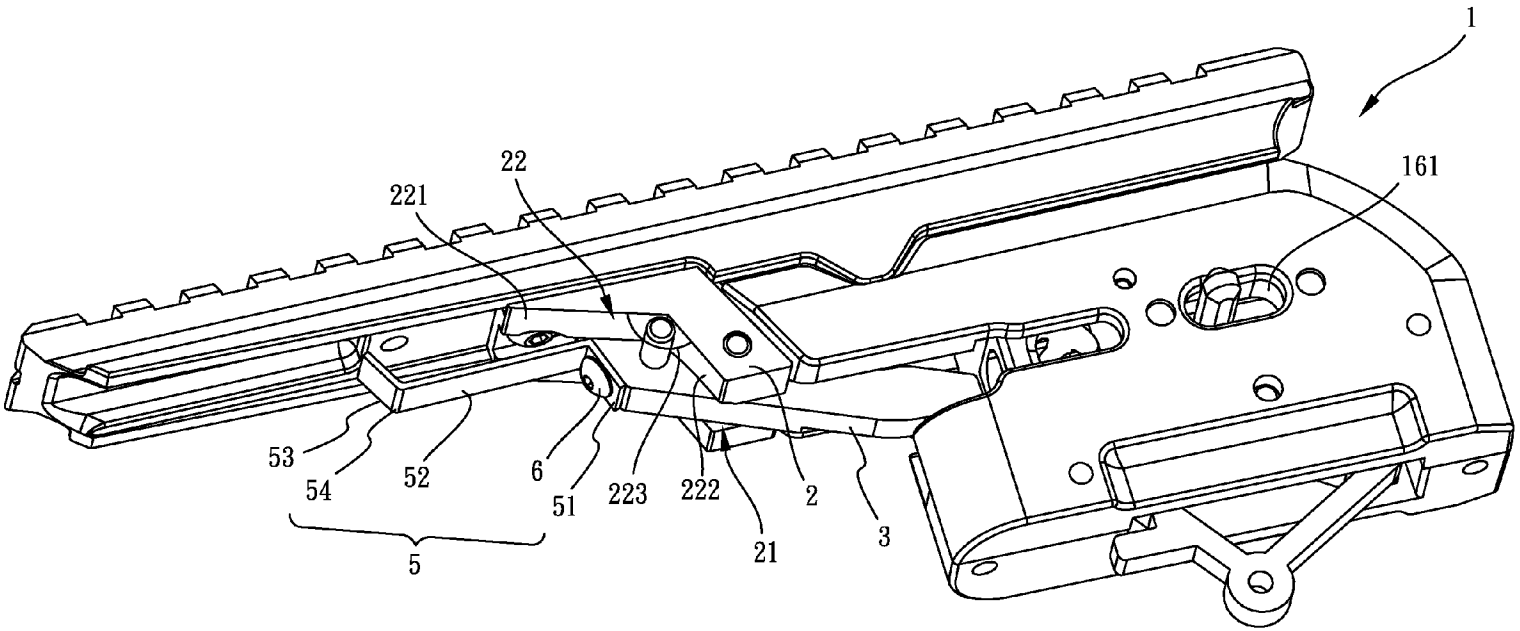
FIG. 3 is a perspective view to show the arrow retention device of the present invention and a portion of the shooting device of the crossbow.
Figure 4:
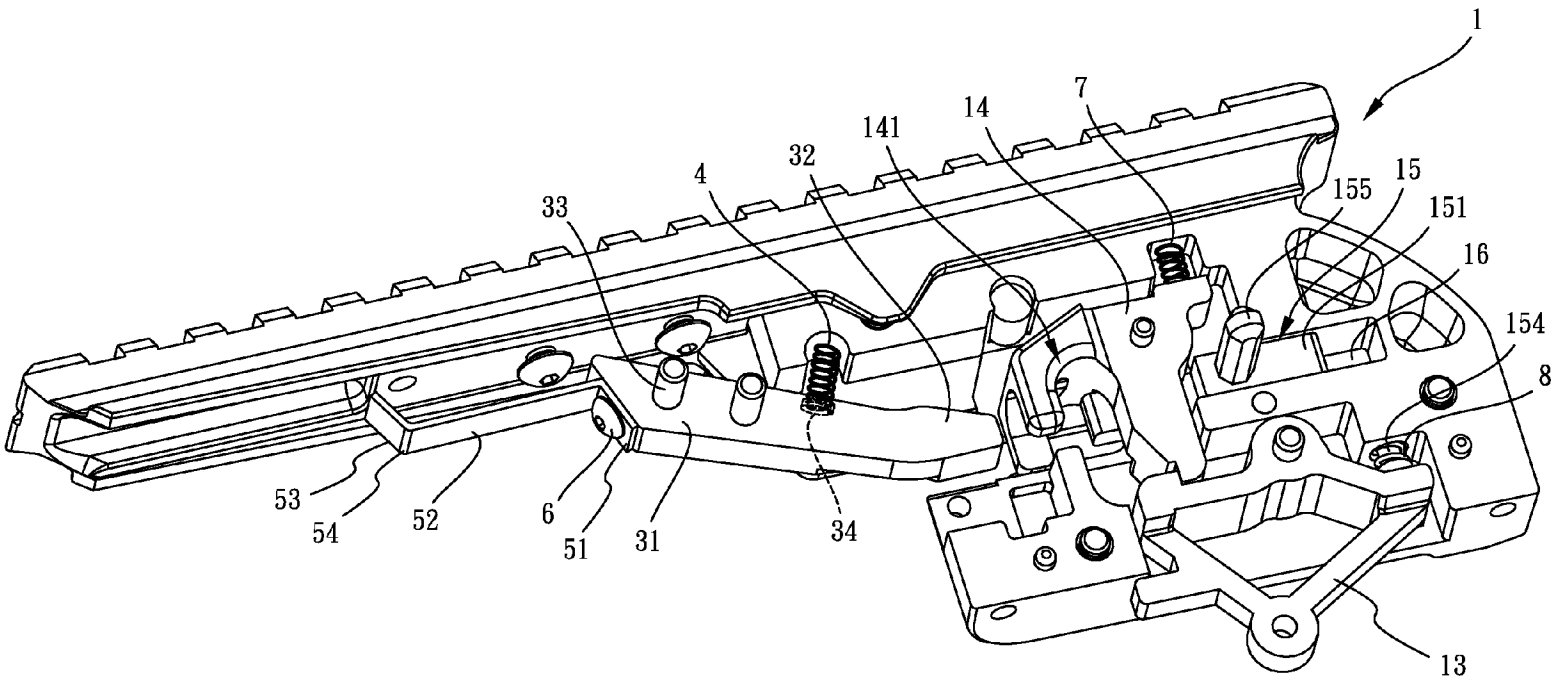
FIG. 4 is another perspective view to show the arrow retention device of the present invention and a portion of the shooting device of the crossbow.
Figure 5:
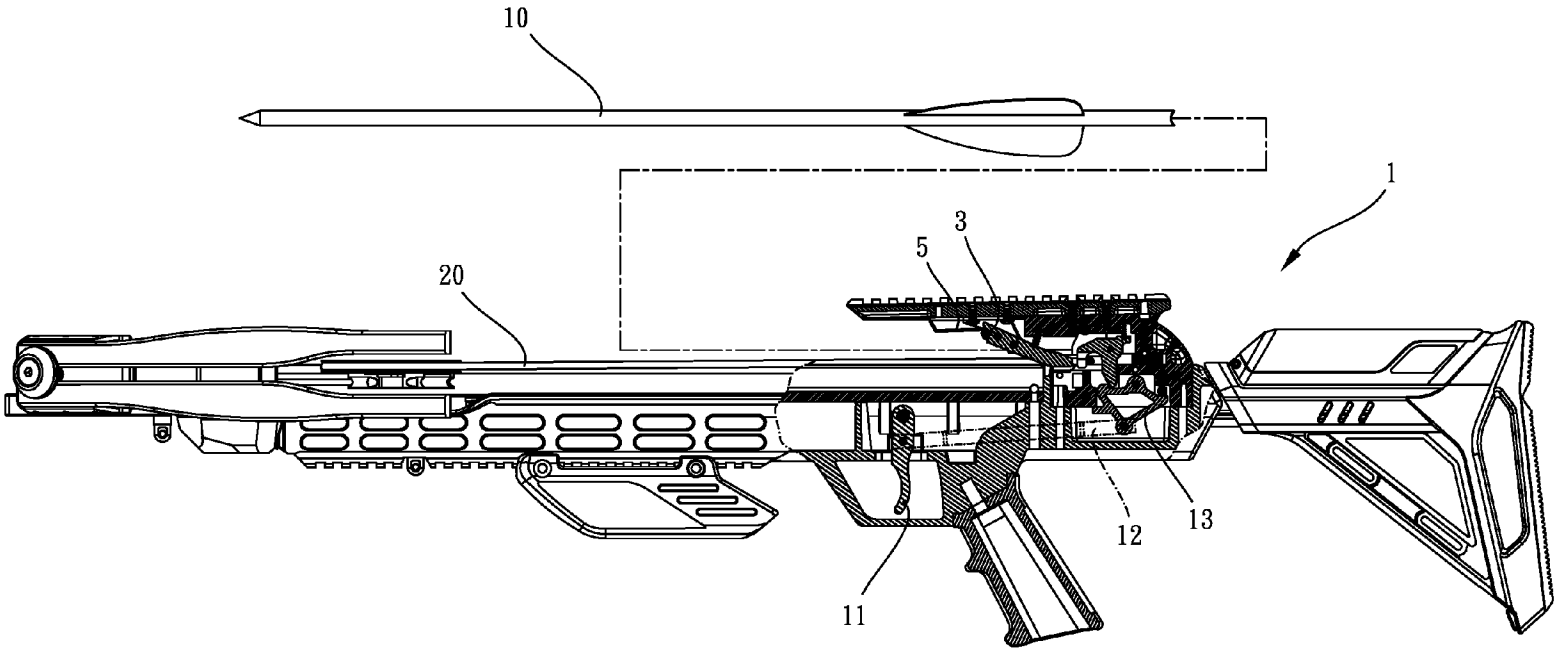
FIG. 5 is a partial cross sectional view to show the arrow retention device of the present invention.

As shown in FIG. 3, a bolt 6 extends through the connection portion 51 of the retention member 5 and is connected to the first end 31 of the arm 3. The retention member Scan also be connected to the arm 3 by other known methods such as adhering, magnetic attracting, or snapping.

The shooting device 1 comprises a trigger 11, a link 12, a driving member 13 and a striking member 14. The trigger 11 is exposed beyond the body of the crossbow, and the link 12 and the driving member 13 are installed in the body of the crossbow. The link 12 is connected between the trigger 11 and the driving member 13. The striking member 14 is located in the shooting device 1 and hooked to the driving member 13. The striking member 14 is located beside the arm 3 and has a hook 141 which is used to hook the string 20 of the crossbow. As shown in FIGS. 9 and 10, when the trigger 11 is pulled, the link 12 is driven to pivot the driving member 13. The driving member 13 is pivoted to separate striking member 14 from the driving member 13. A resilient member 7 is located on the top of the striking member 14. The resilient member 7 is biased between the striking member 14 and the shooting device 1. The resilient member 7 pivots the striking member 14 to release the string 20 to shoot the arrow 10. The string 20 and the arrow 10 are located on a common horizontal plane.

The shooting device 1 includes a safety unit 15 which is located beside the driving member 13 and the striking member 14. The safety unit 15 includes a safety pin 151, a positioning spring 152, a ball 153 and a restriction pin 154. A control rod 155 extends from each of two sides of the safety pin 151 and is exposed beyond the shooting device 1. The shooting device 1 has a path 16 in which the safety pins 151 are slidably received. An oval opening 161 is defined in each of two sides of the path 16. The control rods 155 slidably extend through the oval openings 161. The safety pins 151 each have two first slots 156 defined in the top thereof. The positioning spring 152 and the ball 153 are secured to the shooting device 1. The ball 153 is engaged with one of the two first slots 156, the positioning spring 152 is biased between the shooting device 1 and the ball 153. The restriction pin 154 has a second slot 157 and a passage 158. The passage 158 communicates with the second slot 157 and the path 16. A spring 8 is received in the second slot 157. The restriction pin 154 has a first end thereof biasing the driving emmer 13, and a second end of the restriction pin 154 extends through the second slot 157, the spring 8 and the passage 158. The safety pin 151 slides in the path 16 and presses the restriction pin 154 to restrict and secure the driving member 13 under the safety mode as shown in FIG. 6. The safety pin 151 slides in the path 16 and away from the restriction pin 154, and the driving member 13 is pivoted to push the restriction pin 154 which extends through the passage 158 and reaches into the path 16 under a shooting mode as shown in FIG. 9.

The cooperation of the arm 3 and the retention member 5 ensures that the arrow 10 does not shift. The speed of the arrow 10 that leaves from the crossbow is not reduced. The arm 3 brings the retention member 5 does not generate noise. The users can quickly shoot arrows 10 consecutively because the arm 3 is quickly pivoted after the previous arrow 10 leaves from the crossbow.

While we have shown and described the embodiment in accordance with the present invention, it should be clear to those skilled in the art that further embodiments may be made without departing from the scope of the present invention.

What is claimed is:

1. An arrow retention device of a crossbow, comprising:

a fixing member (2) having one end thereof fixed to a shooting device (1), an installation slot (21) defined axially in an underside of the fixing member (2);

an arm (3) pivotably inserted into the installation slot (21) and having a first end (31) and a second end (32), the first end (31) being exposed beyond the installation slot (21), the second end of the arm (3) inserted into the shooting device (1), a restriction rod (33) extending from each of two sides of the arm (3), a pushing spring (4) connected to a top of the arm (3), the pushing spring (4) biased between the second end (32) of the arm (3) and the shooting device (1);

a retention member (5) connected to an end face of the first end (31) of the arm (3) and comprising a connection portion (51), a shank (52) and a guide portion (53), the connection portion (51) connected to the end face of the first end (31) of the arm (3) and a first end of the shank (52), a second end of the shank (52) connected to the guide portion (53), the connection portion (51) and the guide portion (53) respectively extending toward two opposite directions, a contact portion (54) formed at a connection portion of the shank (52) and the guide portion (53), the contact portion (54) adapted to press an arrow (10);

when the arrow (10) is put in the shooting device (1), a rear end of the arrow (10) pivots the arm (3) so that the first end (31) of the arm (3) drives the retention member (5) toward the arrow (10), the contact portion (54) presses the arrow (10), the second end (32) of the arm (3) compresses the pushing spring (4), when the shooting device (1) is activated to shoot the arrow (10), the arrow (10) leaves from the arm (3) and the pushing spring (4) releases a recovery force and the arm (3) is pivoted back, and the contact portion (54) is separated from the arrow (10).

2. The arrow retention device of a crossbow as claimed in claim 1, wherein the fixing member (2) includes two notches (22) which are located corresponding to the restriction rods (33), each notch (22) includes a first inclined face (221) and a second inclined face (222), an angled area (223) is formed between the first and second inclined faces (221, 222), an angle of the angled area (223) is larger than 90 degrees or equal to 90 degrees, the restriction rods (33) are engaged with the angled area (223) when the arm (3) is not pivoted, the restriction rods (33) are move away from the angled area (223) when the arm (3) is pivoted.

3. The arrow retention device of a crossbow as claimed in claim 2, wherein the arm (3) includes a recess (34) which is located corresponding to the pushing spring (4), one end of the pushing spring (4) is securely engaged with the recess (34).

4. The arrow retention device of a crossbow as claimed in claim 1, wherein the arm (3) includes a recess (34) which is located corresponding to the pushing spring (4), one end of the pushing spring (4) is securely engaged with the recess (34).

5. The arrow retention device of a crossbow as claimed in claim 1, wherein a bolt (6) extends through the connection portion (51) of the retention member (5) and is connected to the first end (31) of the arm (3).

6. The arrow retention device of a crossbow as claimed in claim 5, wherein the shooting device (1) comprises a trigger (11), a link (12), a driving member (13) and a striking member (14), the trigger (11) is adapted to be exposed beyond a body of the crossbow, the link (12) and the driving member (13) are adapted to be installed in the body of the crossbow, the link (12) is connected between the trigger (11) and the driving member (13), the striking member (14) is located in the shooting device (1) and hooked to the driving member (13), the striking member (14) is located beside the arm (3) and has a hook (141) which is adapted to hook a string (20), when the trigger (11) is pulled, the link (12) is driven to pivot the driving member (13), the driving member (13) is pivoted to separate striking member (14) from the driving member (13), a resilient member (7) is located on a top of the striking member (14), the resilient member (7) is biased between the striking member (14) and the shooting device (1), the resilient member (7) pivots the striking member (14) to release the string (20), the string (20) and the arrow (10) are located on a common horizontal plane.

7. The arrow retention device of a crossbow as claimed in claim 6, wherein the shooting device (1) includes a safety unit (15) which is located beside the driving member (13) and the striking member (14), the safety unit (15) includes a safety pin (151), a positioning spring (152), a ball (153) and a restriction pin (154), a control rod (155) extends from each of two sides of the safety pin (151) and is exposed beyond the shooting device (1), the shooting device (1) has a path (16) in which the safety pins (151) are slidably received, an oval opening (161) is defined in each of two sides of the path (16), the control rods (155) slidably extend through the oval openings (161), the safety pins (151) each have two first slots (156) defined in a top thereof, the positioning spring (152) and the hall (153) are secured to the shooting device (1), the ball (153) is engaged with one of the two first slots (156), the positioning spring (152) is biased between the shooting device (1) and the ball (153), the restriction pin (154) has a second slot (157) and a passage (158), the passage (158) communicates with the second slot (157) and the path (16), a spring (8) is received in the second slot (157), the restriction pin (154) has a first end thereof biasing the driving member (13), a second end of the restriction pin (154) extends through the second slot (157), the spring (8) and the passage (158), the safety pin (151) slides in the path (16) and presses the restriction pin (154) to restrict and secure the driving member (13) under a safety mode, the safety pin (151) slides in the path (16) and away from the restriction pin (154), and the driving member (13) is pivoted to push the restriction pin (154) which extends through the passage (158) and reaches into the path (16) under a shooting mode.

* * * * *